US007523589B1

(12) United States Patent
Smith

(10) Patent No.: US 7,523,589 B1
(45) Date of Patent: Apr. 28, 2009

(54) PORTABLE FLOOD BARRIER PANEL

(75) Inventor: Jason W. Smith, Pawling, NY (US)

(73) Assignee: The Presray Corporation, Pawling, NY (US)

( * ) Notice: Subject to any disclaimer, the term of this patent is extended or adjusted under 35 U.S.C. 154(b) by 204 days.

(21) Appl. No.: 11/395,869

(22) Filed: Mar. 31, 2006

(51) Int. Cl.

| | |
|---|---|
| ***E06B 3/26*** | (2006.01) |
| ***E06B 3/28*** | (2006.01) |
| ***E06B 3/68*** | (2006.01) |
| ***E06B 7/00*** | (2006.01) |
| ***E06B 9/01*** | (2006.01) |
| ***E05B 65/04*** | (2006.01) |
| ***E05C 7/02*** | (2006.01) |
| ***E06B 3/32*** | (2006.01) |

(52) U.S. Cl. ..... 52/202; 52/203; 49/62; 49/63; 49/55; 49/463

(58) Field of Classification Search ..... 52/202, 52/203, 204.1, 656.7, 730.3, 734.1, 736.1; 49/61, 62, 55, 463; 16/422, 419, 420, 430; 403/389

See application file for complete search history.

(56) References Cited

U.S. PATENT DOCUMENTS

| | | | | |
|---|---|---|---|---|
| 2,487,596 | A * | 11/1949 | Sackstein | 190/26 |
| 2,848,762 | A * | 8/1958 | Peterson | 52/127.6 |
| 3,861,081 | A * | 1/1975 | Maskell | 49/70 |
| 4,781,296 | A * | 11/1988 | Morris et al. | 383/205 |
| 4,928,431 | A * | 5/1990 | Kuzuhara et al. | 49/479.1 |
| 5,077,945 | A * | 1/1992 | Koeniger | 52/169.14 |
| 5,501,044 | A * | 3/1996 | Janesky | 52/169.5 |
| 5,768,833 | A * | 6/1998 | Golen | 52/202 |
| 5,885,024 | A * | 3/1999 | Zupan et al. | 403/389 |
| 5,943,832 | A | 8/1999 | Russell | |
| 6,315,495 | B1 * | 11/2001 | Starheim | 405/129.8 |
| 6,393,782 | B1 * | 5/2002 | Berridge et al. | 52/239 |
| 6,405,497 | B1 * | 6/2002 | Christopolous | 52/202 |
| 6,425,707 | B1 * | 7/2002 | Baxter | 405/87 |
| 6,427,396 | B1 | 8/2002 | Harrison | |
| 6,591,553 | B1 * | 7/2003 | Vaughn | 49/466 |
| 6,931,802 | B2 * | 8/2005 | Jones et al. | 52/202 |
| 2003/0110717 | A1 * | 6/2003 | Rodriguez | 52/202 |

FOREIGN PATENT DOCUMENTS

| | | |
|---|---|---|
| DE | 40 23 286 | 1/1992 |
| EP | 0 841 458 | 5/1998 |
| GB | 2 114 197 | 8/1983 |

* cited by examiner

*Primary Examiner*—Brian E. Glessner
*Assistant Examiner*—Ryan Franks
(74) *Attorney, Agent, or Firm*—Schweitzer Cornman Gross & Bondell LLP

(57) ABSTRACT

An Adjustable flood-resistant barrier for removable installation in a window or door opening or the like. A laterally adjustable frame is received within an elastic envelope and can be laterally expanded to engage the sides and bottom of the opening. An adjusting mechanism includes a shaft, which projects upward above the top of the frame, approximately in the center thereof, and mounts a handle for both carrying the panel and rotating the shaft to effect width adjustments of the panel. An improved peripheral seal minimizes the likelihood of leakage at the corners. For wide openings, mullions are provided to support central areas and to increase downward sealing pressures in the center of the panel. Mullions can also be positioned between an opposed pair of barrier panels for closing off unusually wide openings.

4 Claims, 11 Drawing Sheets

PORTABLE FLOOD BARRIER PANEL

BACKGROUND OF INVENTION

Homes and buildings located in flood plain areas may be subject to occasional inundation with water during flood periods. In order to minimize the damage and inconvenience from such occasions, devices have been proposed for removable installation in door and window openings located at or below expected flood levels. When installed, such barriers prevent or substantially minimize the inflow of flood waters within the height limits of the barrier panels. An example of such is shown in UK Patent Application No. 2,114,197, which discloses a hinged mechanism which is installed in a bag formed of extensible material. When the center of the mechanism is pressed downward, the sides are extended laterally to readjusted positions to lock the mechanism in the doorway or window.

European Patent 0,841,458 shows a relatively crude form of adjustable frame mechanism, which supports a flexible barrier sheet within a doorway opening.

German Patent DE 4,023,286 shows an adjustable framework with turnbuckle arrangements for width adjustment and providing downward pressure. A barrier panel 4 is engaged at the edges of the framework to provide a flood barrier.

The Harrison U.S. Pat. No. 6,427,396 discloses a laterally adjusted frame, actuated by an expansion mechanism which supports an extensible panel. The panel stretches with the frame to provide a flood barrier when the frame is installed in a doorway or the like. The extensible panel covers only the front of the frame, in order to provide access to the adjusting mechanism.

A particularly desirable form of flood barrier is reflected in the Russell U.S. Pat. No. 5,943,832, owned by Presray Corporation, Pawling, N.Y. The Russell patent discloses a laterally extendable frame, operated by an expansion mechanism, which is received within a laterally extensible envelope. The mechanism is accessible from the top of the envelope for effecting width adjustment after the frame is positioned within the opening to be sealed.

SUMMARY OF THE INVENTION

The present invention relates to improvements in the flood barrier panels of the type referred to above which incorporates numerous improvements to facilitate the installation and removal of the barrier panel and to provide more effective sealing of the opening when the barrier is installed for flood protection.

Pursuant to one aspect of the invention, the laterally adjustable frame is designed such that the elements of the frame are generally symmetrical, and an adjustment linkage is provided centrally in the framework, connected to the opposite sides thereof and operated by a vertical threaded shaft extending through an upper element of the frame and projecting upwardly somewhat beyond the top of the frame. A carrying handle is fixed to the upper end of the threaded shaft and serves both as a convenient means for carrying the panel and as a lever for rotating the threaded shaft to achieve expansion and contraction of the barrier frame. This has two important advantages: First, it provides for significantly greater efficiencies in carrying the barrier panel to the desired site and installing it. Second, it allows the frame to be adjusted from within the extensible envelope, while enabling the envelope to have a fold-over flap at the top to prevent the envelope from slipping off of the frame when the frame is in a retracted configuration. The carrying handle advantageously is removably attached to the threaded shaft, such that it can be removed, when necessary, as when the barrier panel is installed tightly adjacent a door surface, for example, which may interfere with the swinging of the handle for adjusting the framework. In such cases, the handle is removed and a wrench or the like is used to rotate the threaded shaft to effect the desired width adjustment.

The barrier panel of the invention also includes an improved and advantageous form of edge seal, which is secured along side and bottom edges of the extensible envelope and provides for tight sealing around the perimeter of the opening to be sealed, accommodating imperfections in the straightness of the perimeter elements. The edge seal advantageously is formed with side flanges which are splayed slightly outward in their normal configuration and spread laterally when subjected to pressure during the installation of the panel in the door or window opening. The arrangement is such that the pressure of the water against the outer flanges tends to press them tighter against the adjacent supporting surface, to enhance the sealing action of the perimeter seal. Improvements are also made for sealing the lower corner extremes of the barrier panels, which historically have been the most difficult areas to effect a complete seal. In the device of the invention, the perimeter seal is miter cut at the corners to provide a severe right angle configuration without rounding, and, in addition, soft foam inserts are provided in grooves in the perimeter seal, at the corner extremities, to further enhance the sealing capabilities at such corner extremities.

A further advantageous feature of the invention resides in the provision of a guard panel on an outer face of the adjustable frame, arranged to cover the expansion mechanism and threaded operating shaft in all positions of the frame. In this respect, when the elastic envelope in which the frame is received is exposed to the pressure of a head of flood water, the elastic material may become distended inwardly in open areas between elements of the adjustable frame. If permitted to extend inwardly into contact with elements of the expansion mechanism, it may prevent adjustment of such mechanism when the panel is under load and/or cause damage to the elastic material. To avoid any such problems, a flat sheet metal panel is affixed to one side of the adjustable frame and extends laterally over to the opposite frame, in all adjustable positions of the frame. The extensible envelope is thus fully supported in the critical areas by the guard panel and cannot become involved in contact with the expansion mechanism.

In one form of the invention, in which the opening to be sealed is of substantial width, a central supporting mullion is provided, which is secured to the floor and engages central regions of the barrier panel. The mullion not only resists inward forces against the panel, resulting from the pressure of flood waters, but also serves to press the center portions of the panel downward tightly against the floor surface to enhance the sealing action in the center portion of the panel. For openings of even larger width, the mullion may be interposed between two separate panels, such that the two panels are tightened laterally against the center mullion. Advantageously, the mullions are removably attached to the floor, by bolts, for example, such that they can be easily installed when needed and removed between flooding episodes.

For a more complete understanding of the above and other features and advantages of the invention, reference should be made to the following detailed description of preferred embodiments, and to the accompanying drawings.

DESCRIPTION OF THE DRAWINGS

FIG. 10, similar to FIG. 9, with the handle removed and its mounting nuts utilized for manipulation by a wrench or the like.

DESCRIPTION OF PREFERRED EMBODIMENTS OF THE INVENTION

Figure 3:
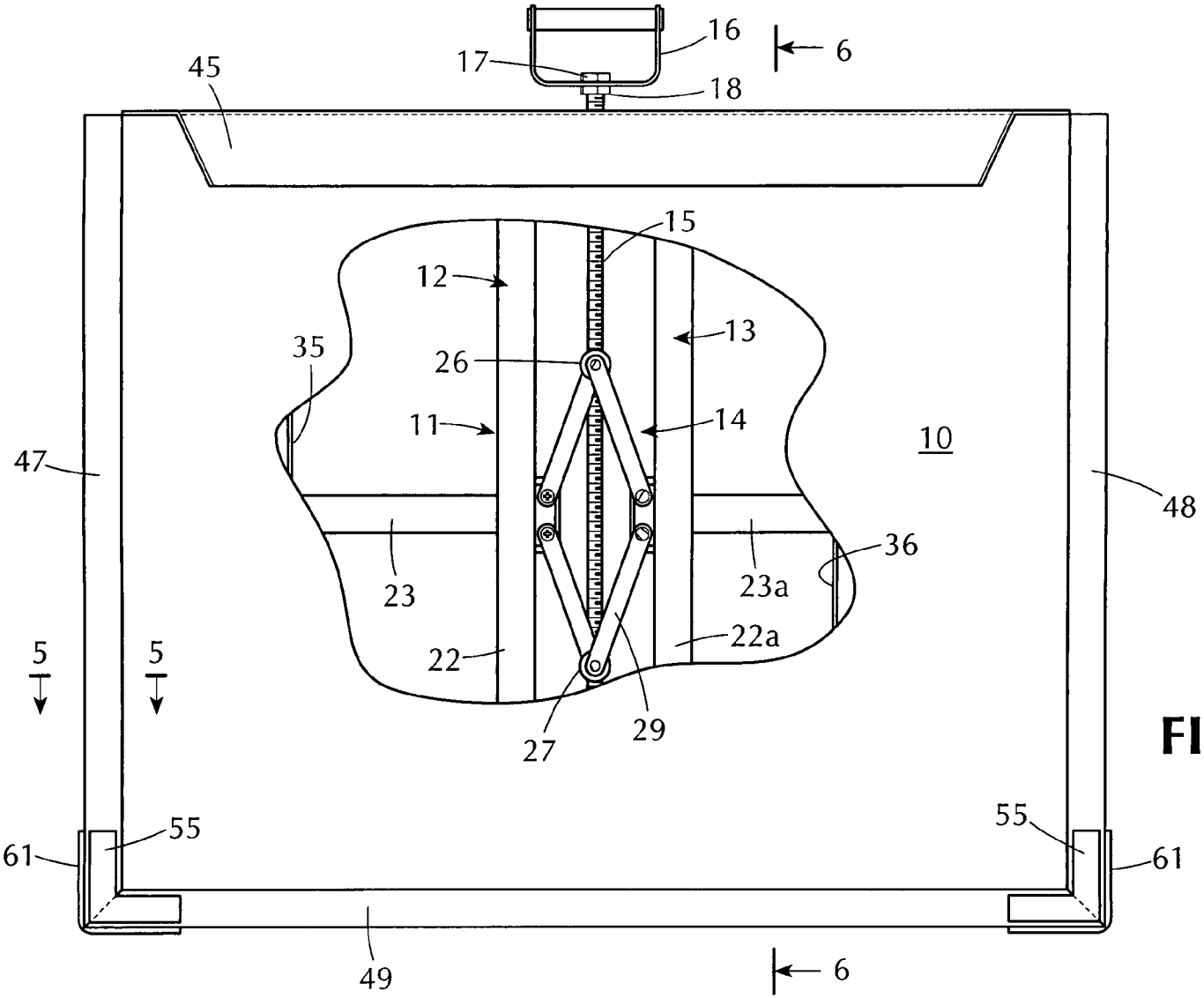
FIG. 3 is a back elevation of the flood panel of FIG. 1.

Referring now to the drawings, the reference numeral 10 designates generally a flood barrier panel according to the invention, which comprises an adjustable frame 11 (FIG. 3) comprised of opposite side frame members 12, 13 connected by an expansion mechanism 14 actuated by a vertical threaded rod 15, which extends upward above the top edges of the frame 11. A handle 16 is mounted at the top extremity of the threaded shaft 15, secured by locking nuts 17, 18 which are positioned respectively above and below the bottom portion of a handle.

Figure 1:
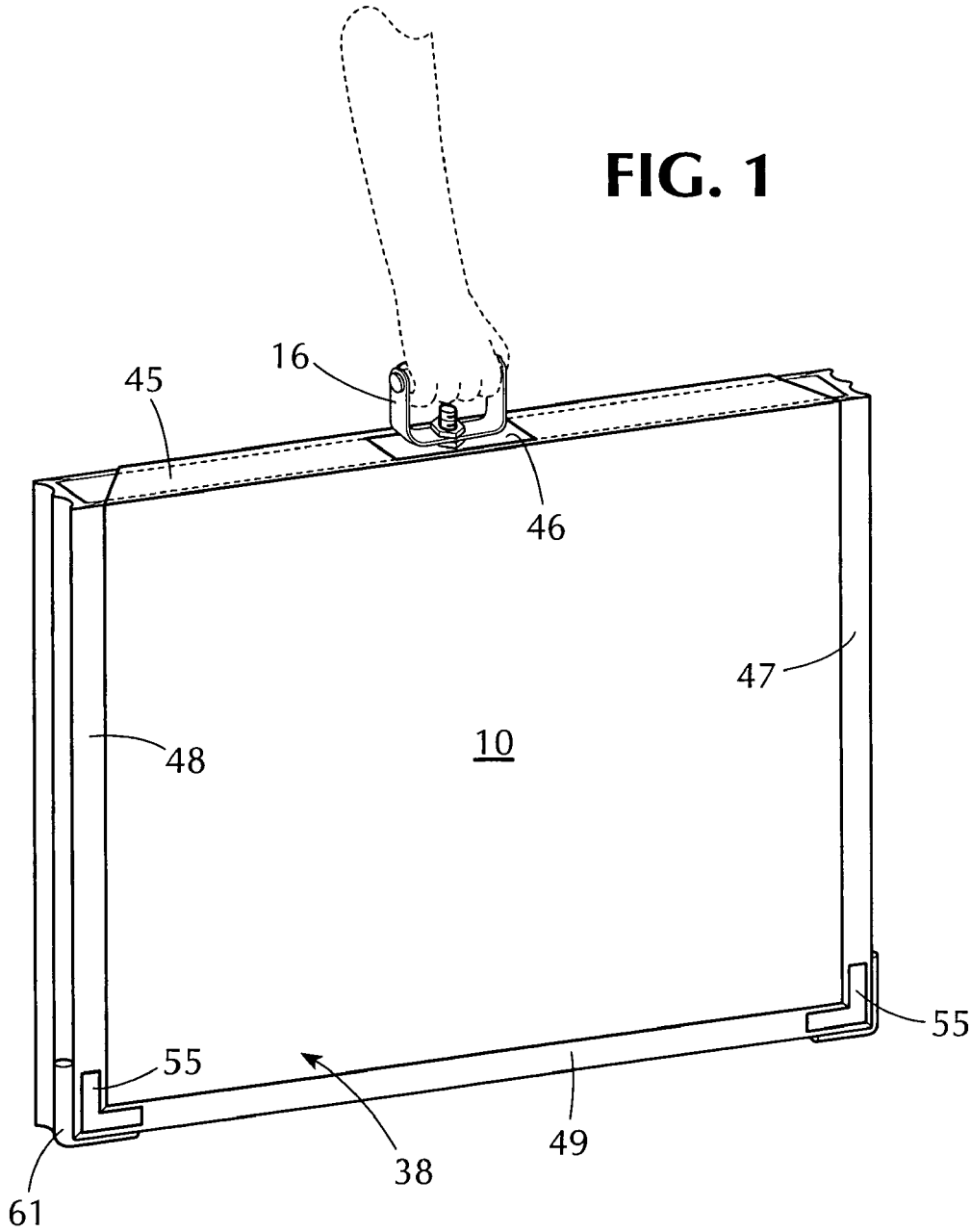
FIG. 1 is a perspective view of a portable flood barrier according to the invention, illustrating the panel being carried by its adjusting handle.
Figure 2:
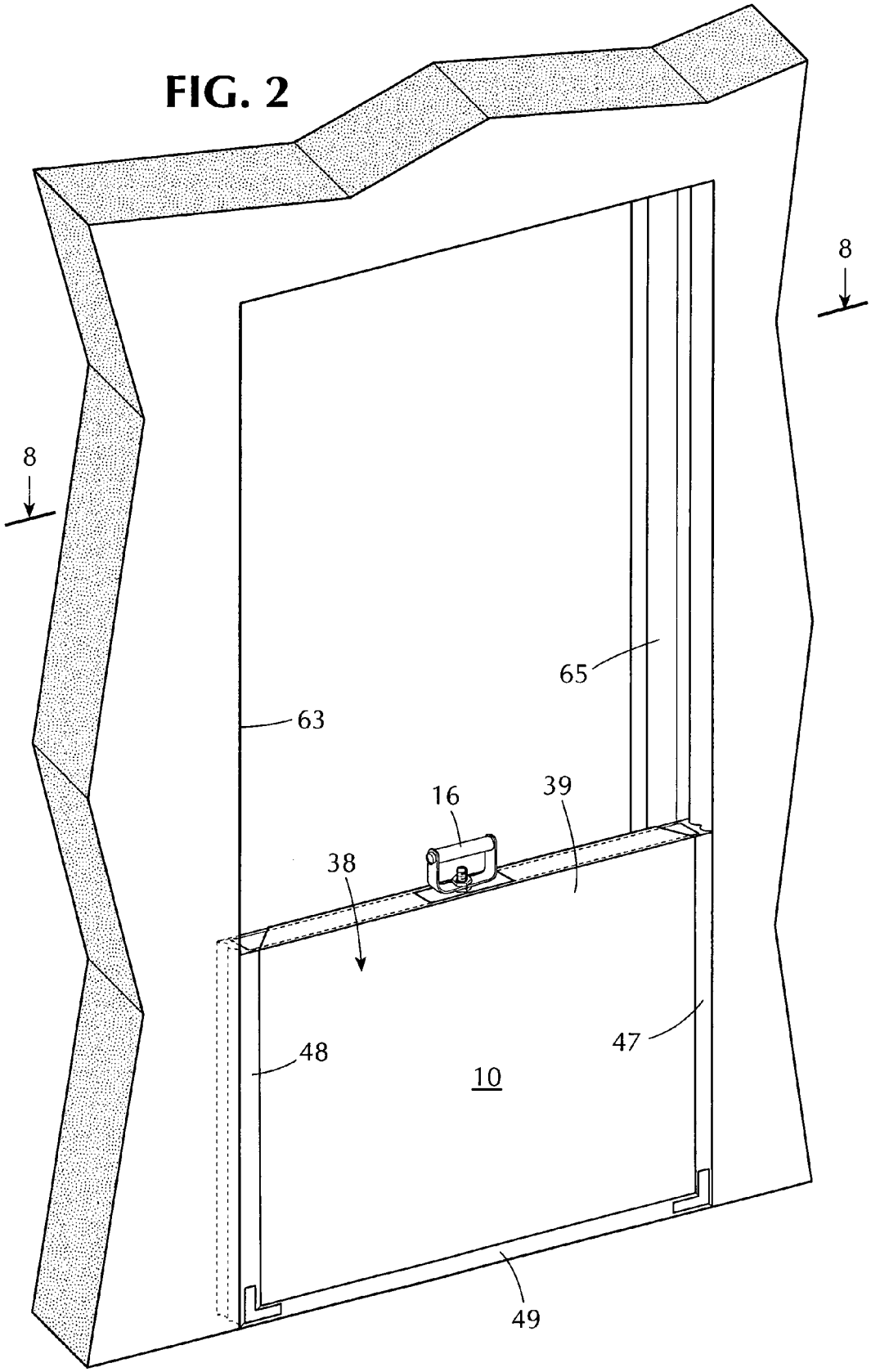
FIG. 2 is a perspective view of the flood barrier panel of FIG. 1, shown installed in a doorway.

The respective frame sections 12, 13 are of substantially equal size and weight, such that the threaded shaft 15 is located substantially on the vertical center line of the panel, with the weight of the panel elements being distributed substantially equally on opposite sides of the shaft. This allows the entire panel to be conveniently picked up and carried by gripping the handle 16, as reflected in FIG. 1. The carry handle 16 also serves as the means for rotating the shaft for expanding and contracting the frame 11, as will appear.

Figure 7:
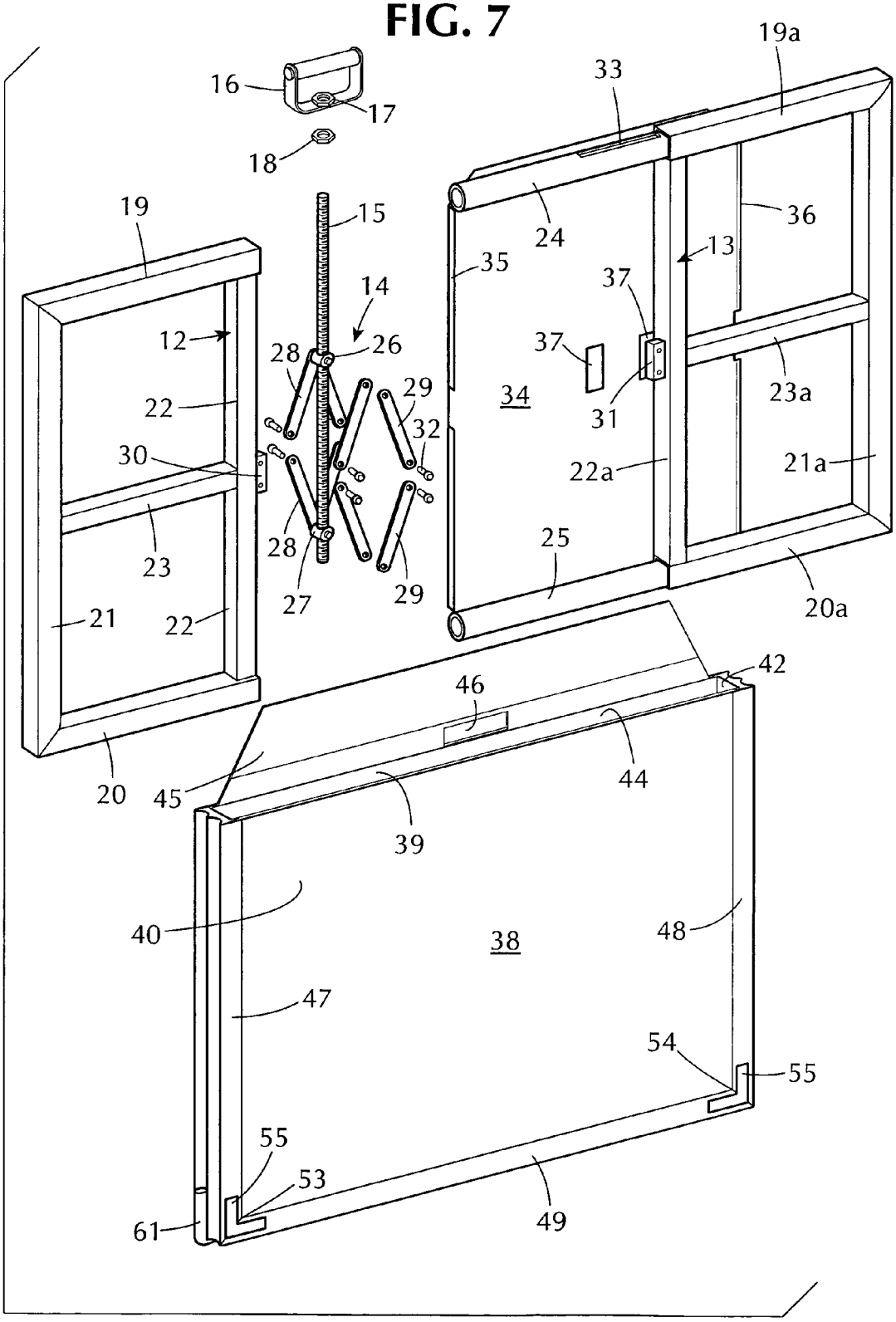
FIG. 7 is an exploded view of the flood barrier panel of FIG. 1.

Details of the structure are shown in the exploded view of FIG. 7. The frame section 12 comprises upper and lower frame sections 19, 20 and a vertical outer frame section 21, all preferably formed of standard 1.5 inch square tubing. A vertical support 22 joins the inner ends of the upper and lower frame sections 19, 20 and is supported centrally by a reinforcing section 23. The frame sections 22, 23 may, if desired, be of slightly smaller size than the outer frame sections 19-21 (for example 1.37 by 1.37), but preferably are of a standard square tubing material.

The opposite frame section 13 is essentially a mirror image of the frame section 12, comprising upper and lower frame sections 19*a*, 20*a*, and a vertical outer edge section 21*a*. A vertical connecting section 22*a* and reinforcing element 23*a* are also provided. The use of such standardized square tubing with the parts joined by welding provides for a generally simplified and economical construction.

The two frame sections 12, 13 are slideably joined together by means of upper and lower circular tubing sections 24, 25. Where 1.5 inch square tubing, for example, is utilized for the upper and lower members 19, 20 and 19*a*, 20*a*, the circular tubing members 24, 25 may be of a standard 1.25 inch circular tubing. The tops and sides of the circular tubing sections 24, 25 are milled or ground slightly flat so as to fit easily inside the square tubing sections 19-20*a*. In the illustrated arrangement, the circular tubing sections 24, 25 are welded or otherwise fixed to the frame section 13 and are slideably received within the tubing sections 19, 20 of the opposite side frame section 12.

Lateral adjustment of the frame sections 12, 13 is accomplished by means of an adjusting mechanism 24 comprising a vertically oriented threaded shaft 25 mounting upper and lower threaded pivot blocks 26, 27. Each pivot block 26, 27 mounts front and back connecting links 28, 29. Outer ends of the connecting links are joined to blocks 30, 31 on outer faces of the vertical supports 22, 22*a*, by means of pins 32. The assembled arrangement, shown in FIG. 3, enables the respective frame sections 12, 13 to be contracted and extended widthwise through rotation of the threaded shaft 15 as will be readily understood.

In the preferred embodiment of the invention, the upper circular tubing section 24 is provided with an axially elongated slot 33 in both its upper and lower sides, of sufficient size to accommodate the threaded shaft 25. When the unit is assembled, as in FIG. 3, the shaft 15 extends upward through the slot 33 and for an additional inch or so above the frame, to enable attachment of the handle 16.

As will be understood, when the two frame sections 12, 13 are adjusted inward and outward, the threaded shaft 15 will remain positioned centrally between the two vertical supports 22, 22*a*, while the upper circular tube section 14 will move relative to the threaded shaft by an amount equal to one half of the change in width. Accordingly, the slot 33 is provided to be of sufficient length to receive the threaded shaft 15 in any adjusted position of the frame sections 12, 13.

In a preferred form of the invention, the front side of the adjustable frame (that is the side that will be facing the flood waters) is provided with a guard panel 34 formed of sheet metal material. Upper and lower edges of the guard panel are secured to the frame sections 19*a*, 20*a* and extend laterally along more or less the full length of the circular tubing sections 24, 25 although not attached thereto. The opposite vertical edges of the panel are bent inwardly at 35, 36 to stiffen the panel, and openings 37 are provided in the panel in order to provide access to the pins 32 for assembly and disassembly of the expansion mechanism 14. The lateral width of the guard panel 34 is such that, in any adjusted position of the frame sections 12, 13, the guard panel will overlie the front of the adjusting mechanism 14.

In the preferred embodiment of the invention, the assembled frame structure is enclosed within an envelope 38 formed of a flexible, resilient material, such as neoprene. The envelope 38 is constructed to have front and back panels 39, 40, side edges 41, 42 and a bottom edge 43. The sizing of the envelope 38 is such that the frame assembly 11, when contracted to a minimum width configuration, is easily received within the upwardly opening pocket 44 formed by the envelope 38. The height of the various panels is such that, when the frame is received therein, the upper edges of the panel are generally even with or slightly above the upper edges of the frame sections 19, 19*a*.

Advantageously, the envelope 38 is formed with a flap section 45 attached to the upper edge of the front panel 39 and foldable over the top opening 44. The flap is provided with an opening 46 to receive the handle 16. When the handle is inserted through the opening 46, the envelope is effectively locked together with the frame structure, and will not fall off, when the panel is carried or stored even if the frame structure is contracted to a minimum width and only loosely received within the envelope. The outer free end of the flap 45 may be tucked inside the back panel 40 if desired.

In accordance with the invention, a peripheral seal is provided along the opposite side and bottom edges of the envelope 38, in the form of edge seals 47, 48 and bottom seal 49. These peripheral seal elements are of extruded form, of uniform cross section, and of a highly resilient, extensible material, preferably a closed cell neoprene foam. As shown best in FIG. 5, the cross section of the peripheral seal 47-49 includes a pair of side flanges 50, 51 which overlap the side edge margins of the front and back envelope panels 39, 40 and are bonded thereto by suitable adhesive. The seal may also be bonded along its inner edge 52 to the side and bottom edges 41-43 of the envelope to provide a secure attachment.

To advantage, the side sections 47, 48 of the peripheral seal are joined to the bottom section 49 by 45 degree miters at 53, 54 to provide a relatively sharp corner for proper seating into the corner extremities of the opening. In each corner area, L-shaped reinforcements 55 are bonded to the respective side and bottom sections 47, 49 and 48, 49, on both the front and back sides, to reinforce the adhesive bond of the mitered corners. In this respect, when the internal frame 11 is expanded widthwise during installation of the unit in a doorway or other opening, the bottom peripheral section 49 is extended longitudinally by the expanded frame. The bottom section 49 is thus placed under elastic tension, which is absorbed in part at the adhesively bonded mitered corners 53, 54, and in part along the bottom surface 52 of the section 49, which is adhesively bonded to the bottom edge 43 of the envelope 38. The L-shaped reinforcements 55 help take up the stress at the corners, where it tends to be more concentrated.

Figure 5:
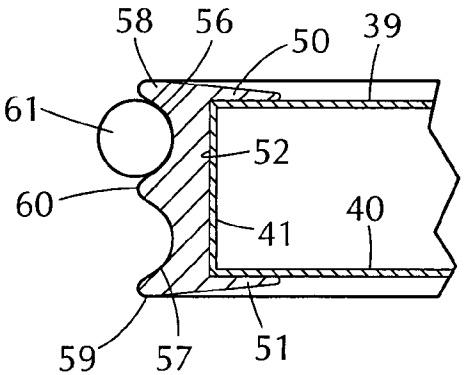
FIG. 5 is an enlarged, fragmentary, cross sectional view as taken for example on line 5-5 of FIG. 3, illustrating details of the perimeter seal.

As shown in FIG. 5, the outer peripheral contours of the seal sections 47-49 comprise a pair of spaced grooves 56, 57, which define side flange portions 58, 59 and a central projection 60. The side flanges 58, 59 are slightly splayed outwardly. Accordingly, when the peripheral seals are pressed tightly against the surfaces of the opening to be sealed, the flange portions 58, 59 tend to flatten and spread outwardly somewhat. When the side flanges 58, 59 are thus configured, the pressure of water against the outer face of the barrier panel will tend to press the outer flange 58 more tightly against the surface on which it is supported, to increase its sealing effectiveness.

The corner areas have historically been the most difficult to seal effectively and frequently are subject to minor leakage. To avoid such minor leakage, the barrier panel of the invention advantageously includes a short soft foam strip of circular cross section, are at each corner, as indicated at 61 in FIG. 5. The foam strips are of a material considerably softer than the closed cell neoprene forming the primary peripheral seal sections 47-49, and short lengths thereof are bonded in the groove 56, extending around the corner extremities for a short distance upwardly and laterally, as best shown in FIG. 7. Because the foam inserts 61 are softer than the material of the seal strips 47, 49, they can simply be placed in the groove 56 and adhesively bonded, being bent around the corner extremities at the mitered corners of the primary sealing strips. The foam strips thus effectively fill in the corner extremities of the opening to be sealed, greatly minimizing or altogether preventing leakage at these corner extremities. In appropriate cases foam inserts 61 can be provided in both grooves 56, 57. However, in many cases a single foam insert at each corner is sufficient and, in many cases, preferable.

Figure 8:
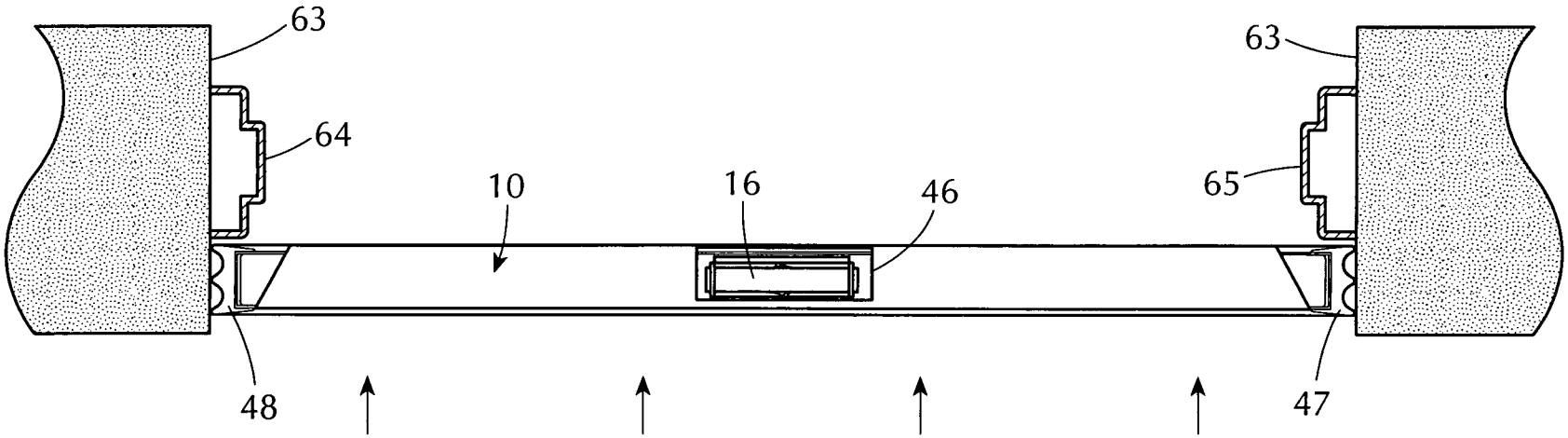
FIG. 8 is a cross sectional view as taken along line 8-8 of FIG. 2, showing the panel installed in a doorway.
Figure 10:
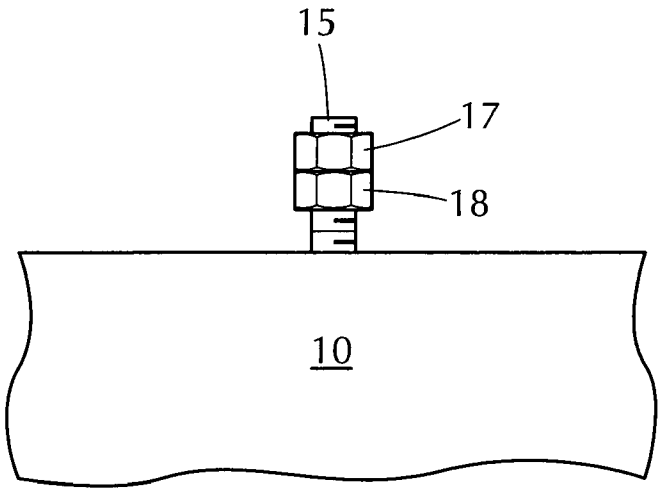
Figure 9:
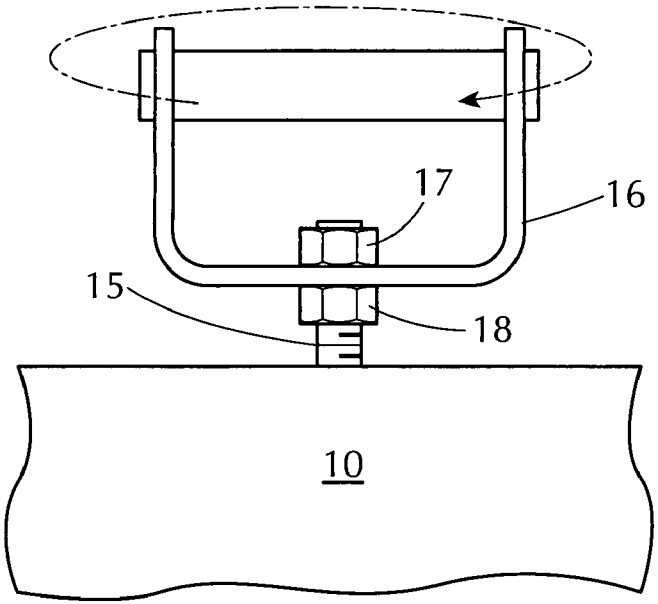
FIG. 9 is an enlarged, fragmentary view illustrating details of the carrying handle.

A typical doorway installation of the barrier panel is shown in FIG. 8, where the door opening 63 is provided with inwardly projecting door jams 64, 65 extending vertically opposite sides. The door jams 64, 65 form an abutment against which the barrier panel 10 may be seated against the pressure of flood waters from the outside. In this arrangement, the barrier panel 10 is typically placed against the front faces of the door jams 64, 65 and expanded laterally until the side seals 47, 48 are tightly compressed against the side walls 63 of the door opening. While the panel 10 is being expanded laterally into contact with the side walls 63, it is simultaneously being pressed downwardly to effect a good seal with the threshold area of the door opening. With a door opening of a typical size, this can be accomplished adequately by pressing downwardly on the handle 16 as it is being rotated to expand the barrier in the width direction.

Figure 12:
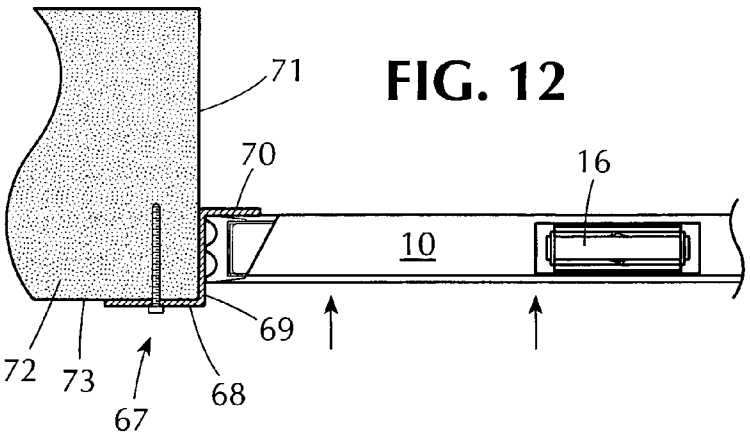
FIGS. 12 and 13 are fragmentary cross sectional illustrations showing alternative arrangements for utilizing the mounting flange of FIG. 11.

In some cases, the opening to be sealed may not be provided with a door jam 64, 65 or other outwardly facing surface suitable for supporting the barrier panel against the inward pressure of flood waters. For such cases, a metal adapter strip, such as shown at 67 in FIG. 11 may be employed. The adapter strip 67 is formed of sheet metal and comprises a mounting flange 68, a spacing flange 69 and an abutment flange 70, each connected to the other by a right angle bend. For installations such as shown in FIG. 12, in which the side walls 71 of an opening have no suitable abutment surfaces, the adapter may be installed as shown by securing its mounting flange 68 to the front surface of the wall structure 72, with the spacing flange 69 extending inwardly along the inside surface of the opening and positioning the abutment flange 70 a short distance in from the outer surface 73 of the structural wall. A similar adapter element is installed along the opposite side of the opening. The arrangement is such that the abutment flanges 70 serve to restrain the inwardly directed forces of the flood waters, and also provide side surfaces against which the peripheral seals can be compressed. Depending on the nature of the opening 71, the adapter elements 67 may be temporarily installed when flood protection is necessary, and removed when the waters have receded, or allowed to remain permanently in place.

Figure 13:
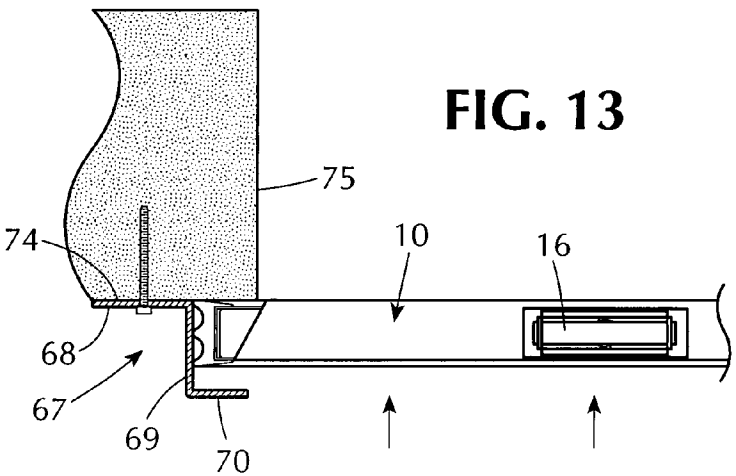
Figure 11:
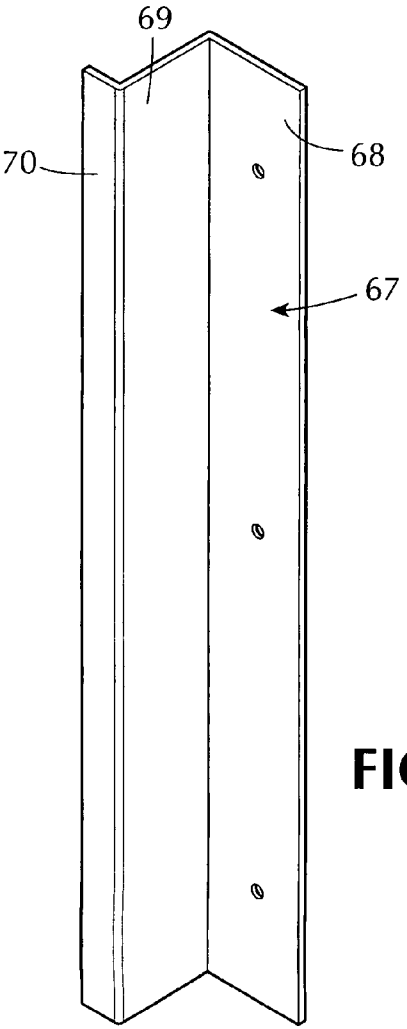
FIG. 11 is a perspective view of an optional mounting flange for use in openings which are not configured to provide a shoulder to support the flood barrier panel.

FIG. 13 illustrates an alternative use of the adapter strip 67 of FIG. 11, in which the mounting flange 68 is secured to the outer face 74 of the structure, with the spacing flange 69 being located a short distance (e.g., a couple of inches) outside of the side wall 75 of the opening to be sealed and extending outwardly. The abutment flange 70 overlies the front face 74 of the structure in spaced relation and forms a channel for the reception of side edge portions of a barrier panel 10. As shown in FIG. 13, the back face of the barrier panel is seated against and supported by the outer surface 74 of the wall structure, and the spacing flange 69 of the adapter element serves as a side surface against which the peripheral seal elements are compressed to form a watertight seal. The arrangement shown in FIG. 13 typically is more suitable to be left permanently in place, as it does not obstruct the doorway opening in any way.

Figure 15:
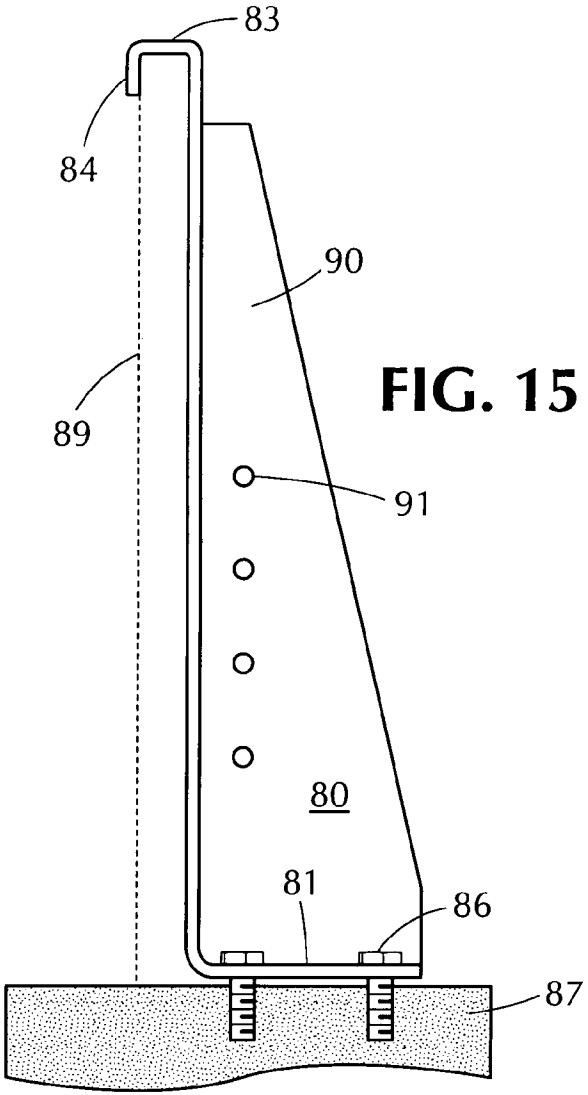
FIG. 15 is a side elevational view of the mullion of FIG. 14, illustrating the mullion as installed with a barrier panel.
Figure 14:
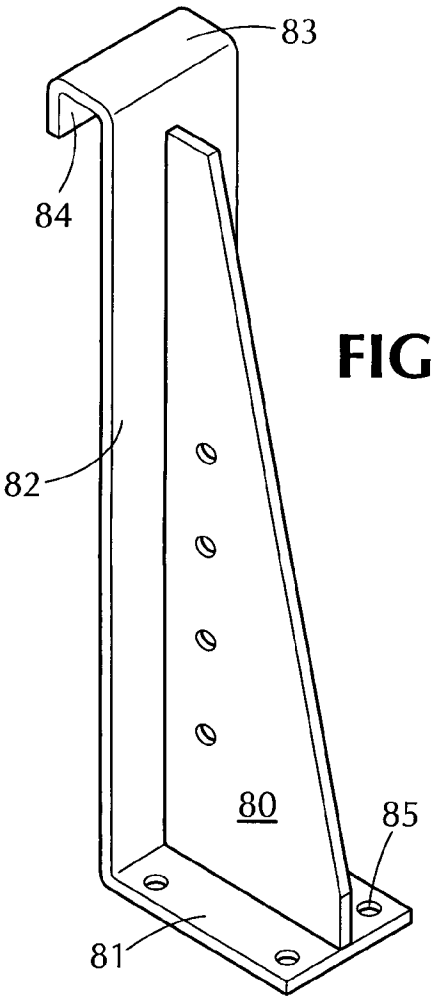
FIG. 14 is a perspective view of a mullion which can be utilized to support central areas of a flood barrier arrangement, in connection with sealing of wide openings.
Figures 16, 17:
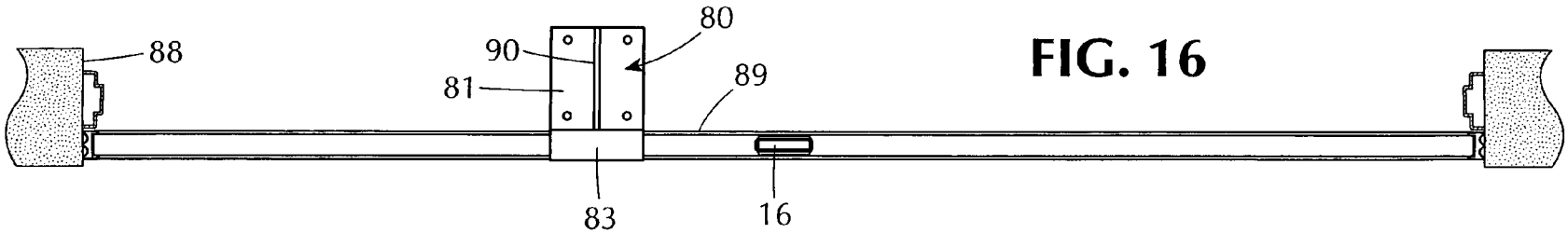
FIG. 16 is a top plan view showing the mullion of FIG. 14 as typically installed in connection with a single panel of substantial width.
FIG. 17 is a front elevational view illustrating a mullion utilized in connection with a pair of panels which, together with the mullion, serve to seal a wide opening.

FIGS. 14 and 15 illustrate a preferred form of mullion 80 which is used to advantage in connection with especially wide doorway openings, such as reflected in FIGS. 16 and 17, providing for better lateral support against the pressure of floodwaters in the central portions of the barrier, and also providing for the utilization of two or more smaller barrier panels in place of a single wide panel. The mullion 80 shown in FIGS. 14, 15 is formed of a rugged material such as steel or aluminum, and comprises a base plate 81, a vertical backing plate 82, a forwardly projecting flange 83 at the top of the backing plate 82, and a retaining flange 84 projecting downward a short distance from the top flange 83. The base plate 81 is formed with a plurality of openings 85 to receive bolts 86 whereby the mullion may be bolted to a floor structure 87. Typically, the bolt anchors (not shown) are preinstalled in the floor structure 87 to receive the bolts 86.

As shown in FIG. 16, a wide door opening 88 may be protected by a single extra-wide barrier panel 89, which extends from one side to the other of the opening. A mullion 80 is installed on the floor, on the inside of the barrier panel 89. An ideal position for the mullion is as close as practicable to the carrying and adjusting handle 16, while allowing adequate clearance for the handle to be rotated.

As shown in FIG. 15, the height of the mullion 80 advantageously is slightly less (for example, ¼-⅜th inch) than the height of the barrier panel 89. Accordingly, when the flanges 83, 84 are positioned over the top edge of a barrier panel 89, as shown in FIG. 15, the base plate 81 of the mullion advantageously is elevated slightly above the top surface of the flooring structure 87. When the bolts 86 are tightened, vertically downward pressure will be applied to the barrier panel 89, to provide a more effective seal along the bottom edge. A similar result could be achieved by inserting appropriate spacers underneath the forwardly projecting flange 83.

Because the mullion 80 may be required to support a significant horizontal load when resisting flood waters bearing against the outside of the barrier panel 89, a gusset panel 90 advantageously is welded to the back of the mullion and to the base plate 81 to prevent flexing of the backing plate 82. Desirably, the gusset plate 90 may be provided with a plurality of threaded holes 91 adapted to receive the bolts 86 when the mullion is not installed in a working position. In this respect, since the flood barrier panels normally are used only on occasion, the mullion typically will be removed and stored with the panel between flooding episodes. To minimize the chance that the bolts will be lost or mislaid during the storage period, they can be threaded into the openings 91 where they will be readily available for the next occasion of use.

Figure 18:
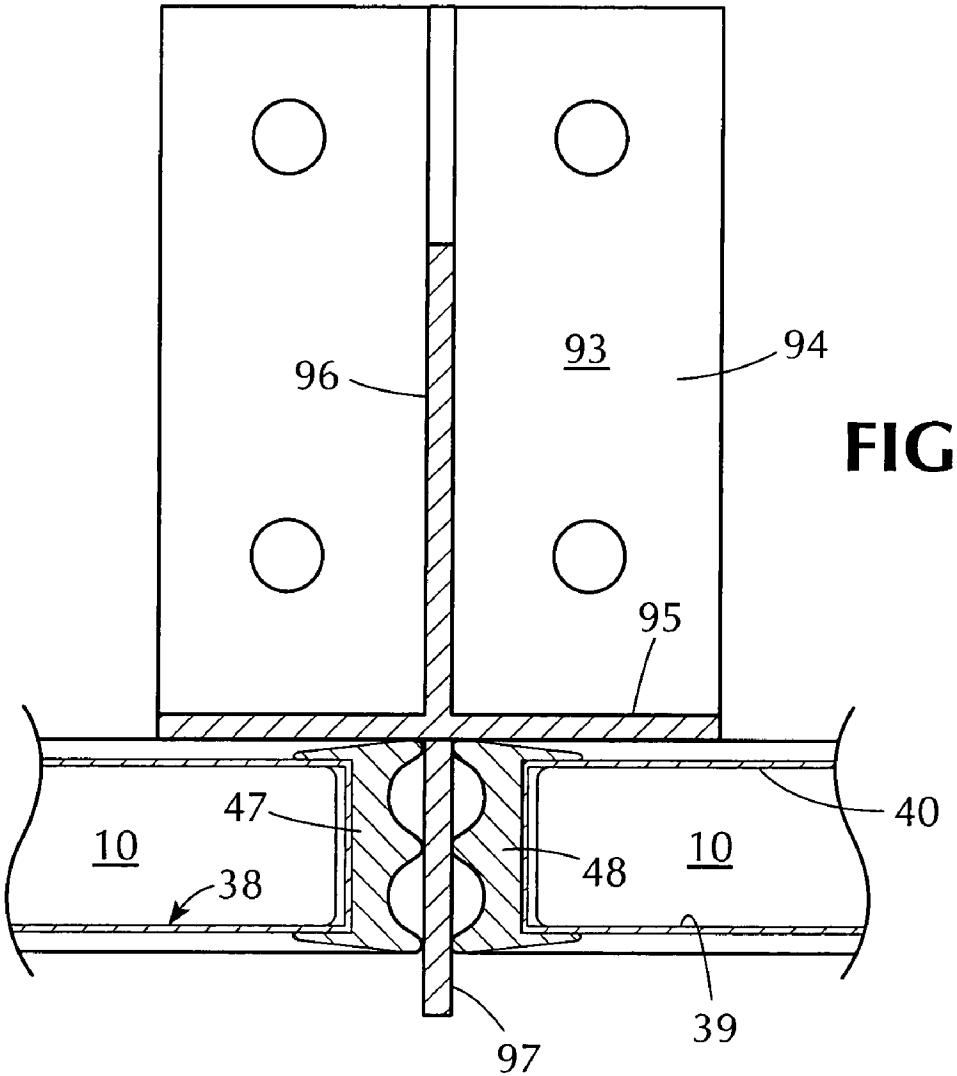
FIG. 18 is an enlarged, fragmentary, cross sectional view as taken generally on line 18-18 of FIG. 17.

Referring now to FIGS. 17 and 18, there is illustrated an alternative arrangement utilizing two or more barrier panels 10 for securing an extra-wide door opening 92. A mullion 93 is installed in the center of the opening, being bolted to the floor in the same manner as the mullion 80, shown in FIG. 15. The mullion 93 comprises a base plate 94, a backing plate 95, a gusset panel 96 and, in addition, a forwardly projecting partition plate 97. As in the case of the mullion 80, the mullion 93 includes a top flange 98 and downwardly projecting retainer flange 99 arranged to overlie the tops of the barrier panels 10.

Installation of the pair of barrier panels 10, for securing the opening 92, is performed in the same manner as previously described. The two barrier panels are inserted in position, separated by the partition plate 97 of the central mullion 93, and the two panels are expanded laterally, more or less together, so as to press tightly against the side walls of the opening 92, and the opposite surfaces of the partition plate 97.

As will be appreciated, an opening of almost any lateral dimension can be protected in the manner reflected in FIGS. 17 and 18, by providing an appropriate number of panels, with the separating mullion 93 between each pair.

Figure 6:
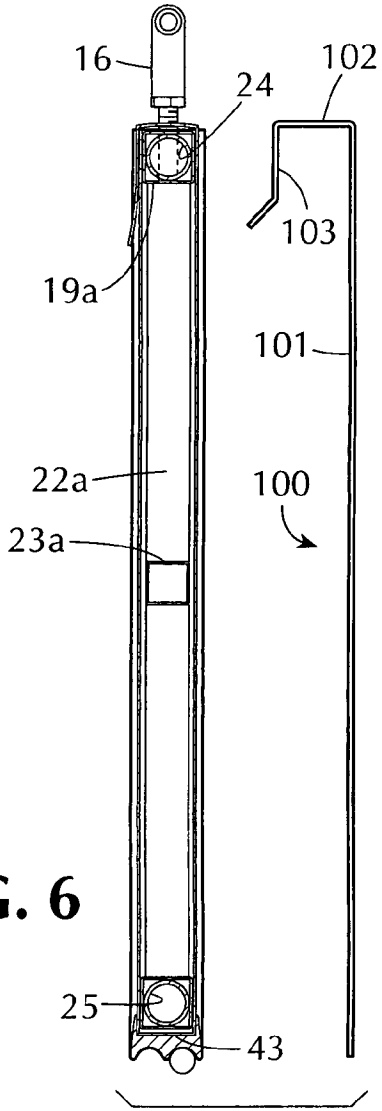
FIG. 6 is a cross sectional view as taken generally on line 6-6 of FIG. 3, and additionally illustrating a form of debris panel that may optionally be employed with the flood barrier.
Figure 4:
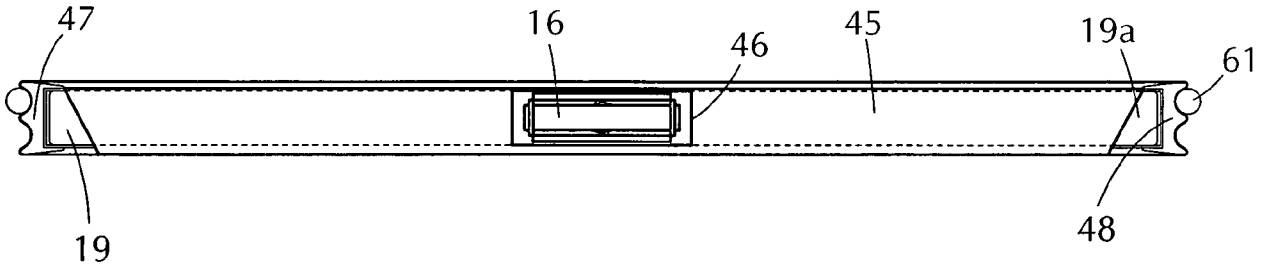
FIG. 4 is a top plan view of the barrier panel.

Under some circumstances, where there may be a considerable current of water flowing past an installed barrier panel, there can be concern that rapidly moving debris may contact the outer face of the elastomeric envelope 38 and cause a puncture. For such circumstances, it may be advantageous to utilize a debris shield 100 (FIG. 6), consisting of a section of sheet metal including a front panel 101 of sufficient size to cover substantially the entire front of the elastic envelope. A top flange 102 and downwardly projecting retainer flange 103 are provided to enable the debris shield to be simply hung over the top of an installed barrier panel. In this respect, a sufficient opening (not shown) is provided in the center portion of the top flange 102 to accommodate the handle 16. The front panel 101 of the debris shield serves to deflect debris brought along by flowing currents and enable such debris to pass by without impairing the water-tight integrity of the envelope 38.

The system of the invention provides a superior adjustable flood barrier panel for protecting door and window openings and the like against flood waters. As will be appreciated, flood water protection is only an occasional need, but when the need arises it is important to be able to install the protection quickly and efficiently. The barrier panel of the invention is stored in a ready-to-use condition and can be picked up and carried to the installation site by its carrying/adjusting handle. When the panel is properly positioned in the opening, the carrying handle is rotated to expand the internal frame and secure the opening in a watertight manner.

Highly efficient sealing of the opening is achieved with the barrier panel of the present invention in part by utilizing a particularly advantageous form of peripheral seal element. Sections of the sealing element are bonded to the side and bottom edges of the envelope in which the adjustable frame mechanism is received. The sealing strips are formed of a closed cell foam-like elastomeric material such as neoprene, bonded at mitered corners and reinforced at those corners to accommodate the necessary lateral expansion of the envelope and the lower sealing strip when the barrier panel is installed in an opening.

Advantageously, the cross sectional configuration of the peripheral sealing strips is such that front and back side flanges thereof splay outward somewhat as pressure is applied during installation of the panel. This allows the water pressure on the outside face of the sealing strips to effectively press the sealing strips tighter against the surface supporting it. Sealing effectiveness at the corner extremities is also enhanced by the provision of soft cylindrical foam strips bonded in grooves in the primary sealing strips and extending around the opposite side corners of the sealing strips.

The system of the invention also includes the use of supporting mullions where appropriate, either to provide central support for an extra-wide barrier panel or to enable wide openings to be protected using two or more normal size barrier panels with a separating mullion between each adjacent pair of panels. With the latter arrangement, there is virtually no limit to the width of an opening that can be protected.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. An adjustable flood-resistant barrier for installation in a window or door opening and of the type comprising:

(a) a laterally adjustable frame comprised of opposite side rigid frame sections telescopically joined for lateral adjustment between telescopically expanded and contracted configurations, (b) a water-tight elastic envelope having front and back panels and bottom and side edges, enclosing said frame while elastically accommodating said expanding and contracting lateral adjustment thereof and forming therewith a barrier against floodwaters, (c) an expansion linkage positioned between and engaging said frame sections (d) a threaded shaft engaging said expansion linkage and operable to effect controlled lateral expansion and contraction of said frame, (e) said threaded shaft extending upward above said frame in a central region thereof, (f) said threaded shaft and said expansion linkage being positioned substantially centrally of said barrier, with the weight of said barrier being distributed substantially equally on opposite sides of said shaft, (g) a carry handle fixed to an upper end portion of said threaded shaft, above said frame sections and said elastic envelope, whereby said barrier may be lifted and carried by said carry handle in a substantially balanced manner, rotatable with said shaft for expanding and contracting said frame (h) said threaded shaft being rotatable by said carry handle for laterally expanding and contracting said frame, (i) said carry handle including a bracket portion secured to said threaded shaft and having portions extending outwardly and upwardly from opposite sides of said shaft and a hand-engageable gripping portion engaged at opposite ends by said bracket portion and positioned directly above said threaded shaft, whereby a user's hand gripping said gripping portion will be positioned directly above and aligned with the upper end portion of said threaded shaft (k) said water-tight elastic envelope being provided, along external side and bottom edges thereof, with an elongated extruded elastic sealing element formed of a closed cell elastomeric foam material and adhesively bonded to said side and bottom edges, and being adapted for resilient engagement with bottom and side edges of an opening in which said barrier is installed, (l) said elastic sealing element being comprised of side and bottom sealing strips formed with mitered corners, bonded together at respective lower corners of said elastic envelope, and said bottom sealing strip being elastically extendible with lateral expansion of said frame and said envelope, (m) said elastic sealing element being formed with spaced apart opposite side flanges extending inwardly with respect to edges of said elastic envelope and overlying marginal surface portions of said elastic envelope along the sides and bottoms thereof and being bonded to said marginal surface portions, and (n) said elastic sealing element comprising opposite side spaced apart and divergently related sealing flanges configured to contact surfaces to be sealed in spaced apart areas and so disposed and oriented as tending to initially splay divergently against said surfaces to be sealed upon application of compressive force thereto, such that pressure of water against the outer panel of the barrier panel will tend to cause an outer one of said divergently related sealing flanges to be pressed more tightly onto a surface against which it is initially compressed.

2. An adjustable flood-resistant barrier according to claim 1, wherein said carry handle is removably fixed to said shaft at a location thereon above said frame to enable rotation of said shaft, to expand or contract said frame, by removing said carry handle and engaging a projecting upper portion thereof with a wrench where there is inadequate clearance for rotation of said carry handle.

3. An adjustable flood-resistant barrier for installation in a window or door opening and of the type comprising:

(a) a laterally adjustable frame comprised of opposite side frame sections telescopically joined for adjustment between telescopically expanded and contracted configurations, (b) a water-tight elastic envelope having front and back panels and bottom and side edges, enclosing said frame while elastically accommodating said expanding and contracting lateral adjustment thereof and forming therewith a barrier against floodwaters, (c) an expansion linkage positioned between and engaging said frame sections, and (d) a threaded shaft engaging said expansion linkage and operable to effect controlled lateral expansion and contraction of said frame (e) said threaded shaft extending upward above said frame in a central region thereof, (f) said threaded shaft and said expansion linkage being positioned substantially centrally of said barrier, with the weight of said barrier being distributed substantially equally on opposite sides of said shaft, (g) a carry handle fixed to an upper portion of said threaded shaft, above said frame sections, whereby said barrier may be lifted and carried by said carry handle in a substantially balanced manner, rotatable with said shaft for expanding and contracting said frame, (h) said threaded shaft being rotatable by said carry handle for laterally expanding and contracting said frame (i) said water-tight elastic envelope being open at the top and having a flexible flap joined at a top edge of one of said front or back panels and foldable after installation of said frame into said envelope to overlie upper elements of said frame, (j) said flap being formed with an opening in a center area thereof positioned to be fitted over said carry handle and to engage upwardly projecting portions of said shaft, (k) said flap, when said opening is received over said carry handle, assisting in retaining said envelope positioned on said frame, particularly when said frame is in a telescopically contracted configuration and is being carried by said carry handle (l) said water-tight elastic envelope being provided, along external side and bottom edges thereof, with an elongated extruded elastic sealing element formed of a closed cell elastomeric foam material and adhesively bonded to said side and bottom edges, and being adapted for resilient engagement with bottom and side edges of an opening in which said barrier is installed, (m) said elastic sealing element being comprised of side and bottom sealing strips formed with mitered corners, bonded together at respective lower corners of said elastic envelope, and said bottom sealing strip being elastically extendible with lateral expansion of said frame and said envelope, (n) said elastic sealing element being formed with spaced apart opposite side flanges extending inwardly with respect to edges of said elastic envelope and overlying marginal surface portions of said elastic envelope along the sides and bottoms thereof and being bonded to said marginal surface portions, and (o) said elastic sealing element comprising opposite side spaced apart and divergently related sealing flanges configured to contact surfaces to be sealed in spaced apart areas and so disposed and oriented as tending to initially splay divergently against said surfaces to be sealed upon application of compressive force thereto, such that pressure of water against the outer panel of the barrier panel will tend to cause an outer one of said divergently related sealing flanges to be pressed more tightly onto a surface against which it is initially compressed.

4. An adjustable flood-resistant barrier for installation in a window or door opening and of the type comprising:

(a) a laterally adjustable frame comprised of opposite side frame sections joined for expanding and contracting lateral adjustment, (b) a water-tight elastic envelope comprising front and back panels and bottom and side edges, enclosing said frame while elastically accommodating said expanding and contracting lateral adjustment thereof and forming therewith a barrier against floodwaters, (c) an expansion linkage positioned between and engaging said frame sections, and (d) a threaded shaft engaging said expansion linkage and operable to effect controlled lateral expansion and contraction of said frame;

(e) said water-tight elastic envelope being provided, along external side and bottom edges thereof, with an elongated extruded elastic sealing element formed of a closed cell elastomeric foam material and adhesively bonded to said side and bottom edges, and being adapted for resilient engagement with bottom and side edges of an opening in which said barrier is installed, (f) said elastic sealing element being comprised of side and bottom sealing strips formed with 45 degree mitered corners, bonded together at respective lower corners of said elastic envelope, and said bottom sealing strip being elastically extendible with lateral expansion of said frame and said envelope, (g) said elastic sealing element being formed with spaced apart opposite side flanges extending inwardly with respect to edges of said elastic envelope and overlying marginal surface portions of said elastic envelope along the sides and bottoms thereof and being bonded to said marginal surface portions, and (h) said elastic sealing element comprising opposite side spaced apart and divergently related sealing flanges configured to contact surfaces to be sealed in spaced apart areas and so disposed and oriented as tending to initially splay divergently against said surfaces to be sealed upon application of compressive force thereto, such that pressure of water against the outer panel of the barrier panel will tend to cause an outer one of said divergently related sealing flanges to be pressed more tightly onto a surface against which it is initially compressed.

* * * * *